United States Patent [19]

Engman et al.

[11] 4,122,741

[45] Oct. 31, 1978

[54] POWER SAW CHAIN

[75] Inventors: Thomas Engman, Mullsjö; Dan Ericsson; Goran Landén, both of Huskvarna, all of Sweden

[73] Assignee: Husqvarna AB, Huskvarna, Sweden

[21] Appl. No.: 813,688

[22] Filed: Jul. 7, 1977

[51] Int. Cl.[2] ..... B27B 33/14

[52] U.S. Cl. ..... 83/834; 83/830

[58] Field of Search ..... 83/834, 833, 831, 830

[56] References Cited

U.S. PATENT DOCUMENTS 2,902,068 9/1959 Gudmundsen ..... 83/834

3,977,288 8/1976 Goldblatt et al. ..... 83/834 X

*Primary Examiner*—J. M. Meister

*Attorney, Agent, or Firm*—Holman & Stern

[57] ABSTRACT

A power saw chain comprises a central row of driving links and outer rows of cutting links and side links with each cutting link being laterally aligned with a side link and adjacent a side link longitudinally of the chain. The undersurfaces of said adjacent side links are designed to run on a guide plate surface while the undersurfaces of the cutting links and the laterally aligned side links have clearance from said surface to reduce the vibration effect of the chain.

3 Claims, 3 Drawing Figures

POWER SAW CHAIN

Figure 1:
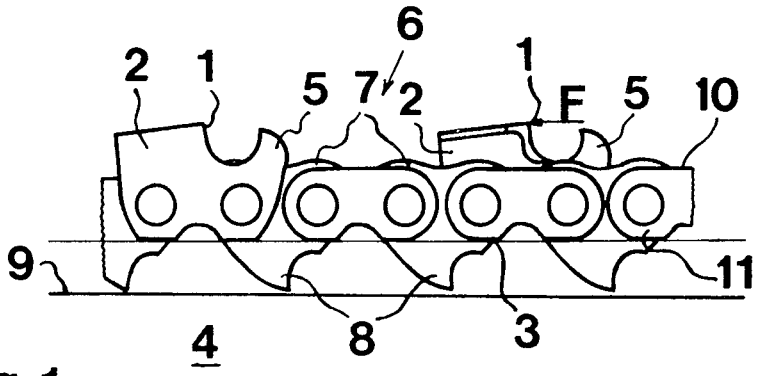
Fig 1 PRIOR ART

The present invention relates to a saw chain of a type which is used in power saws, in particular in devibrated power saws.

It has become more and more customary to equip power saws with vibration-dampening elements by means of which the motor in the saw is insulated, from a point of view of vibration, from the two handles of the saw. Thus the motor is no longer the major problem on the path to a vibration-free power saw. After the motor comes the saw chain as a source of vibrations, and to avoid vibrations from this source it is necessary that this chain operates without thrusts and jerks. A usual cause for the chains used hitherto to have a high vibration level is presumably that the cutting links are subjected to very different loads when cutting through a log. One or two links at a time may, for example, have a considerably greater cutting depth than others which then, more or less, idle. When such a cutting link under high load meets a knot or passes the work onto another link, a jerk occurs in the chain which is felt as vibration. Since this type of vibration is very pronounced when working, for example, in hard-textured wood, it is desirable to find some type of saw chain where jerks of this type are substantially diminished and consequently the vibration level is lower; in other words, a saw chain with a smoother mode of operation than that of the chains known up to now, which in principle have links of an appearance according to the enclosed FIG. 1. When this previously known saw chain moves in a cut, a cutting force F acts upon the cutting edge 1 of a cutting link 2 which owing to this endeavours to swivel round a point 3. Since this lies behind (after) the cutting edge, the cutting edge tends, during the influence of the force F, to lift off the guide plate 4. Consequently the cutting depth will increase and the force F will likewise increase. In practice the swivel movement upwards of the cutting link is limited by a shoulder attachment 5, but since a high cutting speed of the chain is aimed at, this shoulder is located considerably below the cutting edge. As an example it can be said that if the cutting effect is distributed evenly over each cutting link, the cutting depth per link during the greater part of its path through the cut would be less than 0.1mm. The maximum cutting depth per link, as determined by the difference in height between the cutting edge and the shoulder attachment, is in the present case 0.7mm. It is evident from this therefore that the predominant part of the cutting effect can be amassed on one or two cutting links in the cut.

It is the object of the present invention to solve the problem of changing the geometry of the cutting link so that on application of a force F on the cutting edge, the same is given the opportunity to give way in the direction towards the guide plate of the saw. As a result of this characteristic the chain is given a smoother mode of operation, as a result of which the stresses in the chain are reduced. Beside a reduction in the vibrations the risk of chain rupture and the hazard of accident associated therewith is diminished. These and other advantages stated in the following are obtained in a saw chain having cutting links which have a pivot located in the front of the cutting edge in the direction of propulsion of the chain so that the underside of the rear end of the cutting links is provided with play in respect of the guide plate supporting the chain.

An embodiment of a saw chain in accordance with the invention is described in the following, with reference to the enclosed drawing, which shows in FIG. 1 an example of a previously known saw chain, FIG. 2 an example of a saw chain according to the invention, FIG. 3 a further example of a saw chain according to the invention.

For the driving of a saw chain 6 around a saw guide plate periphery, all driving links 7 are provided with projections 8 which at the inner end of the guide plate mesh with teeth on a chain sprocket wheel and are intended to be guided in the guiding track between longitudinal side plates of the saw guide plate. Between each pair of driving links in the chain is a side link 10 which has points of support 11 against the edges of the said side plates. The driving links in one and the same pair are combined by means of cutting links 2 which in the example in FIG. 1 also have supports against the said edges. The cutting links 2 are thus fixed downwards against the guide plate, so that the links obtain a tendency, under the effect of the force F on their edge 1, to be swivelled around the point 3. This causes the problem dealt with in the beginning in previously known chains.

Figure 2:
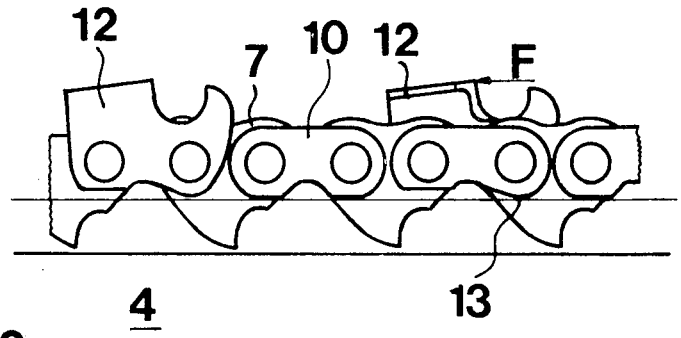

In the example in FIG. 2 one of the points of support on the cutting links 12 has been removed by the levelling of the underside of the rear end of the link. The link has thus been set free of the guide plate at this end, which means that the link now can swivel around a front point of support 13 when a force F is applied to its edge. The chain can nevertheless still operate, because when the link swivels around the front point of support, a moment arises, owing to the tractive force of the chain, on the link which will swivel the same backwards. The link will then be held in a state of equilibrium by the forces which act upon the same during the work. For example, the cutting edge 1 is given the opportunity to give way when passing a hard knot in the wood, instead of giving off an impulse of force as was the case in saw chains according to FIG. 1.

Figure 3:
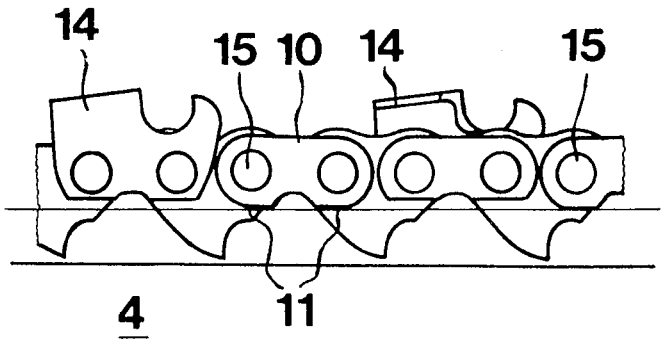

In the example in FIG. 3 the points of support on the cutting links 14 have been removed by the levelling of the undersides of the links, so that the cutting links have been set free of the saw guide plate. The side links 10, however, continue to have two points of support 11 each on the edges of the side plates, which means that the cutting link can now swivel about the rear rivet 15 in the side link. The tractive force in the chain, however, maintains the cutting link raised off the guide plate as can be seen in FIG. 3.

It is apparent that the chains as illustrated comprise a central row of driving links and outer rows of cutting links and side links with each cutting link being laterally aligned with a side link and adjacent a side link longitudinally of the chain. Further the chain portins illustrated are shown in a condition in which the pivots lie in a common plane.

In the chain shown in FIG. 2, the portion of the undersurface of each cutting link under its rear pivot and also the portion of the undersurface of the laterally aligned side link under its rear pivot are more closely spaced to the common plane containing the pivots than is the undersurface of a side link adjacent said cutting link lengthwise of the chain. In the chain shown in FIG. 3, additionally, the portion of the undersurface of each cutting link under its forward pivot and also the portion of the undersurface of the laterally aligned side link under its forward pivot are also more closely spaced to the common plane containing the pivots than the undersurface of the side link adjacent said cutting link lengthwise of the chain.

What is claimed is:

1. A power saw chain comprising interconnected driving links, side links and cutting links, each cutting link having an upper surface defining a cutting edge, a lower surface, a first pivot forwardly of said cutting edge in the direction of propulsion of the saw and a second pivot rearwardly of said cutting edge, said pivots attaching said cutting link to successive driving links respectively, each side link having an upper surface, a lower surface and forward and rearward pivots attaching said link to successive driving links respectively and wherein when the first and second pivots of a cutting link and the forward and rearward pivots of a side link adjacent said cutting link lengthwise of the chain are disposed in a common plane, a portion of said undersurface of said cutting link under said second pivot is spaced more closely to said plane than is the undersurface of said side link.

2. The chain of claim 1 wherein the driving links form a central row between outer rows of cutting links and side links, each cutting link being aligned laterally of the chain with a side link and wherein each side link which is laterally aligned with a cutting link has a portion of its surface under the rearward pivot of said side link spaced a greater distance from said plane than the undersurface of a side link adjacent said cutting link lengthwise of the chain.

3. The chain of claim 2 wherein further portions of the undersurfaces of each cutting link and its laterally aligned side link under the first and forward pivots of said links respectively are also spaced more closedly to said plane than is the undersurface of a side link adjacent said cutting link lengthwise of the chain.

* * * * *